United States Patent [19]

Haryu

[11] Patent Number: 4,479,429

[45] Date of Patent: Oct. 30, 1984

[54] MULTI-COLOR PRINTING APPARATUS OF SURFACES OF BODIES OF ROTATION

[75] Inventor: Koichi Haryu, Matteson, Ill.

[73] Assignee: Yoshino America Corporation, Park Forest South, Ill.

[21] Appl. No.: 360,838

[22] Filed: Mar. 22, 1982

[51] Int. Cl.[3] ..... B41F 17/08

[52] U.S. Cl. ..... 101/38 A

[58] Field of Search ..... 101/38 R, 38 A, 39, 101/40

[56] References Cited

U.S. PATENT DOCUMENTS

| | | | |
|---|---|---|---|
| 2,484,671 | 10/1949 | Bauman | 101/40 X |
| 3,276,356 | 10/1966 | Usko et al. | 101/40 |
| 3,521,298 | 7/1970 | Morel et al. | 101/40 |
| 3,645,201 | 2/1972 | Jackson | 101/38 A |
| 3,960,073 | 6/1976 | Rush | 101/40 |
| 4,035,214 | 7/1977 | Shuppert et al. | 101/40 X |

FOREIGN PATENT DOCUMENTS

| | | | |
|---|---|---|---|
| 2552171 | 6/1977 | Fed. Rep. of Germany | 101/40 |
| 77187 | 6/1981 | Japan | 101/40 |

*Primary Examiner*—Clifford D. Crowder

*Attorney, Agent, or Firm*—Parkhurst & Oliff

[57] ABSTRACT

An apparatus for applying multicolor patterns to the surface of cylindrical plastic articles. Layers of different color inks are successively applied and cured by ultraviolet radiation.

12 Claims, 11 Drawing Figures

MULTI-COLOR PRINTING APPARATUS OF SURFACES OF BODIES OF ROTATION

BACKGROUND OF THE INVENTION

1. Field of the Invention

The present invention relates to an apparatus for multi-color printing on the surfaces of bodies of rotation and, more particularly, to a multi-color printing apparatus for multi-color printing on the surfaces of cylindrical articles such as containers or tubes made of synthetic resins by applying desired colors of ink of ultraviolet-ray set type one by one to their surfaces while being set after each of the ink applications.

2. Description of the Prior Art

It has been conducted according to the prior art to multi-color print the outer circumferences of the synthetic resin articles such as the cylindrical containers or tubes being rotationally driven with multiple colors of ultraviolet-ray set type ink.

According to this multi-color printing process of the prior art, however, the ink in a color to appear is prepared in advance, and different colors of ink are positioned in parallel with the outer circumferences of the articles, but new ink in a different color is not additionally applied to the ink which has already been applied.

If the ink in a different color is additionally applied to the printed ink, more specifically, there arise disadvantages that the overlapped colors of in are mixed to allow an unexpected color to appear and that a printer to print a desired color of ink has its branket blotted with another color of ink, which has already been applied to an article, until the ink in the different color will mixed with the ink in the printer under consideration.

According to the prior art, therefore, it is necessary to prepare multiple colors of ink mixed in advance. This necessity requires not only a number of printers but also a number of printing operations. Thus, the prior art has defects that the cost for facilities is enormously high and that the number of the printing steps required for on article is enlarged.

Even if it is considered that the different colors of ink be not overlapped, moreover, the bracket is blotted with a portion of the ink having been applied to the surface of the article so that the mixture of the ink cannot be completely prevented. In addition, it is necessary to periodically replace the ink and to rinse the printer as a whole.

Even if numerous colors of ink are prepared in advance, still moreover, it is impossible to allow a color of such a half tone as has its color continuously changed. As a result, the color pattern to appear has to be of a uniformity which is difficult to obtain.

SUMMARY OF THE INVENTION

It is, therefore, an object of the present invention to provide a multi-color printing apparatus for multi-color printing of the surfaces of cylindrical articles such as containers or tubes made of synthetic resin, without any mixture between or among different colors of ink, by applying desired colors of ink of ultraviolet-ray set type one by one to their surfaces while being set after each of the ink applications.

Another object of the present invention is to enable a half tone near a natural color to appear with a reduced number of colors.

Still another object of the present invention is to ensure a more precise printing registration.

The present invention has been conceived so as to eliminate the defects, disadvantages and dissatisfactions concomitant with the prior art thus far described, and is featured by the construction that ink in each color is set and dried, immediately after its printing step has been ended, so that subsequent ink in a different color can be applied in an overlapped manner to the ink which has already been applied.

DESCRIPTION OF THE PREFERRED EMBODIMENT

The present invention will be described in the following in connection with one embodiment thereof with reference to the accompanying drawings.

Figure 6:
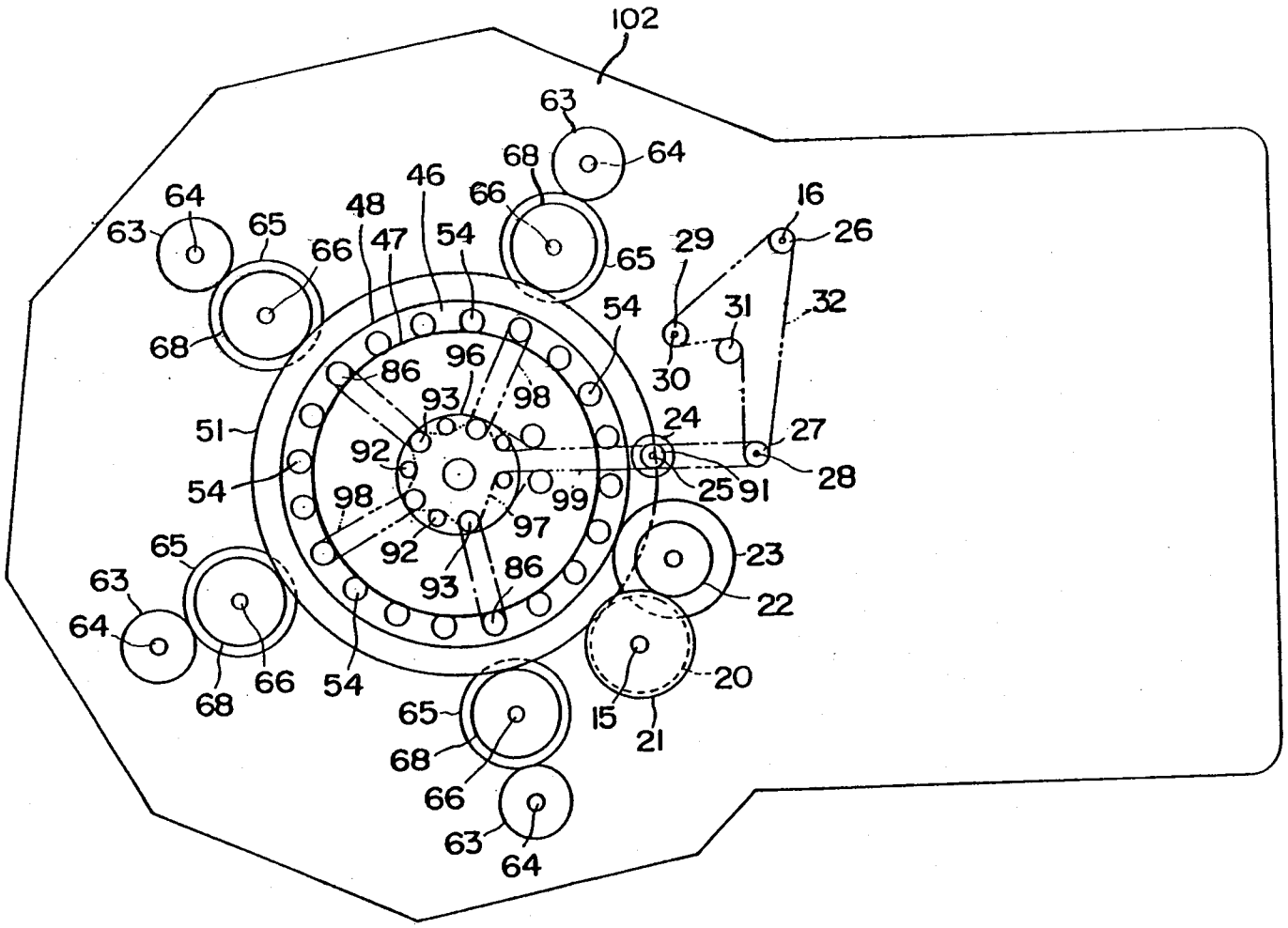
FIG. 6 is a top plan view showing the arrangements of respective portions which are rotationally driven by the drive mechanism.

The multi-color printing apparatus according to the present invention is constructed to comprise: a table mechanism 4 including an index table 44, which supports at positions of an equal center angle (e.g., 18 degrees in the shown embodiment, as shown in FIG. 6) on the circumferential edge portion thereof a plurality of such holding jigs 53 in rotatable manners and in upright positions as are made operative to hold thereon cylindrical articles S made of a synthetic resin and which are made intermittently rotatable or adapted to be indexed at the above-specified equal center angle, and an article rotating cylinder 46 and a printing rotary ring 50 both of which are coaxially assembled in the index table 44; a plurality of printers 6 which are arranged to face the articles S held on the aforementioned holding jigs 53 without any slippage and stopped at predetermined positions so that they may print the outer circumferences of the articles S in desired colors of ink of ultraviolet-ray set type with desired patterns; a plurality of setting mechanisms 3 are arranged along the transferred passages of the articles S downstream of the aforementioned respective printers so as to irradiate the outer circumferences of the articles with an ultraviolet ray thereby to set the ink just applied; a loading mechanism for receiving articles S to be printed from the outside of the apparatus and for loading them onto the aforementioned holding jigs 53; an unloading mechanism for unloading the articles S, which have been printed with the patterns in the desired multiple colors, so that the unloaded articles S may be carried out; a rotation transmitting mechanism 2 for transmitting the rotationally driving force to the article rotating cylinder 46 and the printing rotary ring 50 of the aforementioned table mechanism 4, the brackets 62 of the printers 6, the loading mechanism 5 and the unloading mechanism 7; and a drive mechanism 1 for rotationally driving the index table 44 of the aforementioned table mechanism 4 in an intermittent manner at the aforementioned equal center angle and for transmitting the rotational force at a constant speed to the aforementioned rotation transmitting mechanism 2. Moreover, the multi-color printing apparatus according to the present invention is constructed such that the brackets 62 of the aforementioned printers 6 and the articles S held on their holding jigs 53 are continuously rotated while having an identical circumferential speed.

In addition to the constructions thus far described, in order to more ensure the registrations among the patterns in different colors to be printed on one article S by the respective printers 6, there are provided a plurality of article clamping mechanisms 8 for clamping the articles S, which are held on the holding jigs 53 stopped at positions to face the respective printers 6, on the same holding jigs 53. The article clamping mechanisms 8 are constructed such that their clamping shafts 84 for exerting the clamping forces upon the articles S are rotated in the same direction and at the same speed as those of the holding jigs 53.

In the case of the embodiment shown, incidentally, the respective constructional mechanisms thus far described are mounted on a box-shaped bed 101 which is covered with a mounting platform 102.

Figure 4:
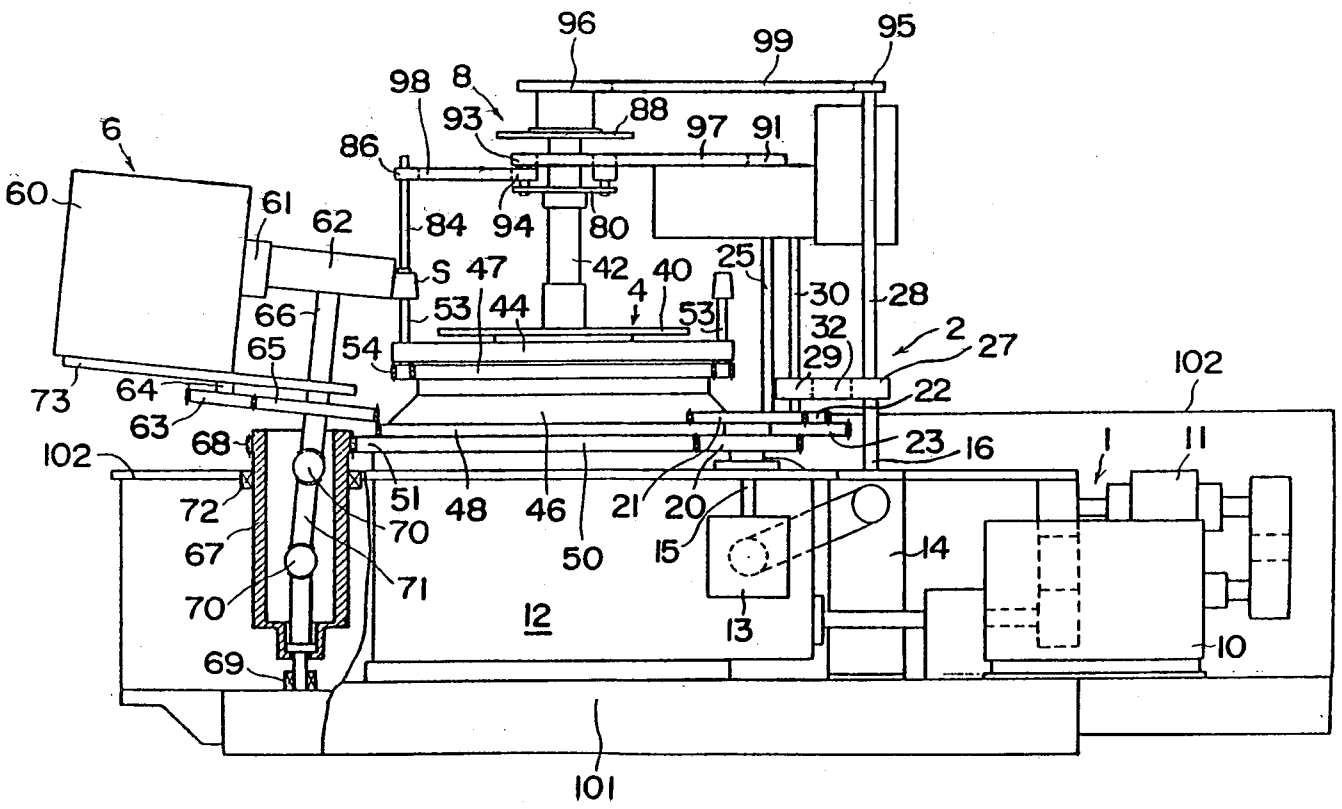
FIG. 4 is a front elevation showing the whole construction of a drive transmission system.
Figure 5:
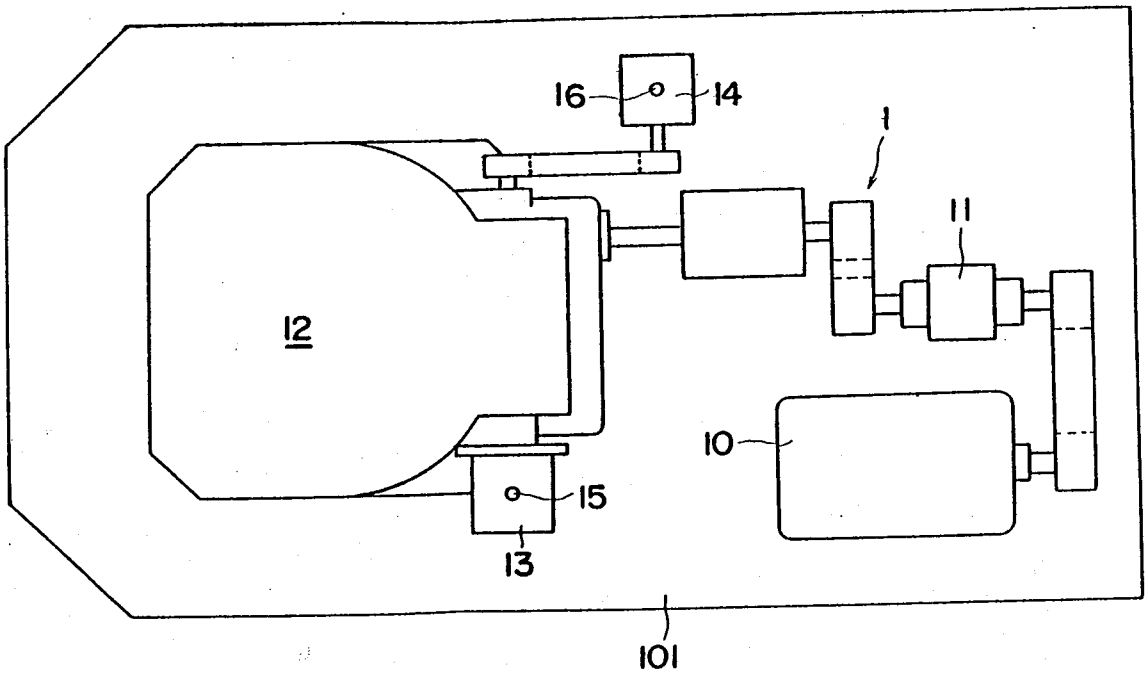
FIG. 5 is a top plan view showing the arrangement of a drive mechanism.

In the following description, the constructions of the respective mechanisms of the present invention will be separately explained:

Drive Mechanism 1 (with reference to FIGS. 4 and 5)

The drive mechanism 1 is a unit for imparting the driving force to the respective mechanisms of the apparatus according to the present invention and is arranged in the box-shaped bed 101. The drive mechanism 1 thus arranged is constructed to include a main motor 10 acting as a variable motor, a clutch brake 11, an index unit 12, a first gear box 13 and a second gear box 14. The rotational driving force from the main motor 10 is transmitted through a transmission belt to the clutch brake 11, from which it is further transmitted through a transmission belt to such an input shaft of the index unit 12 as is borne on a bearing.

This index unit 12 has integrated therewith the index table 44 of the table mechanism 4. The constant speed rotating force fed to that index unit 12 is partly converted into the intermittent rotating force of the index table 44 and partly fed as it is as the constant speed rotating force to the first gear box 13 and likewise through a transmission belt to the second gear box 14.

Moreover, the first and second gear boxes 13 and 14, to which the constant speed rotating force is transmitted through the index unit 12, are equipped with first and second upright shafts 15 and 16, which are made operative to rotate at constant speeds, respectively.

In short, the drive mechanism 1 arranged in the bed 101, partly transmits the intermittent rotating force of the equal center angle to the index table 44, which is positioned above the mounting platform 102, and partly continuously rotate the first and second upright shifts 15 and 16, which are positioned to have their upper ends protruding upward from the mounting platform 102, at the constant speeds.

Rotation Transmitting Mechanism (with reference to FIGS. 4 and 6)

The rotating transmitting mechanism 2 is a unit for transmitting the constant-speed continuous rotating force from the drive mechanism 1, i.e., the rotating forces of the first and second upright shafts 15 and 16 to the table mechanism 4, the printers 6, the article clamping mechanisms 8, the loading mechanism 5 and the unloading mechanism 7, respectively, so that these mechanisms may be driven at predetermined timings. To the upper end of the first upright shaft 15 protruding upward from the mounting platform 102, there is fixed an assembly which is integrally constructed of a first gear 20 meshing with the toothed portion 51 of the printing rotary ring 50 of the table mechanism 4 and a transmission gear 21. To a rotary shaft which is fixed upright on the mounting platform 102, there is rotatably attached an assembly which is integrally constructed of an intermediate gear 22 meshing with the aforementioned transmission gear 21 and a second drive gear 23 meshing with the second toothed portion 48 of the article rotating cylinder 46 of the table mechanism 4. To the lower end of a holding rotary shaft 25 which is rotatably arranged upright, there is fixed a follower gear 24 which meshes with the second toothed portion 48 of the article rotating cylinder 46 similarly to the aforementioned second drive gear 23. Moreover, a drive roller 26 is fixed to the upper end of the second upright shaft 16 which protrudes upward from the aforementioned mounting platform 102. By making a transmission belt 32 run on not only the aforementioned drive roller 26 but also both a loading roller 27, which is fixed to the lower end of a loading shaft 28 rotatably mounted upright on the mounting platform 102, and an unloading roller 29 which is fixed to the lower end of an unloading shaft 30 rotatably mounted upright on the mounting platform 102, both the loading shaft 28 and the unloading shaft 30 are rotationally driven.

In the case of the embodiment shown, moreover, in order to transmit the rotating force of the drive roller 26 more precisely and reliably to the loading roller 27 and the unloading roller 29, a guide roller 31 acting as a tension roller is rotatably mounted on the mounting platform 102 so that the transmission belt 32 is made to run not only the drive roller 26, the unloading roller 29 and the loading roller 27 but also the guide roller 31.

Figure 7:
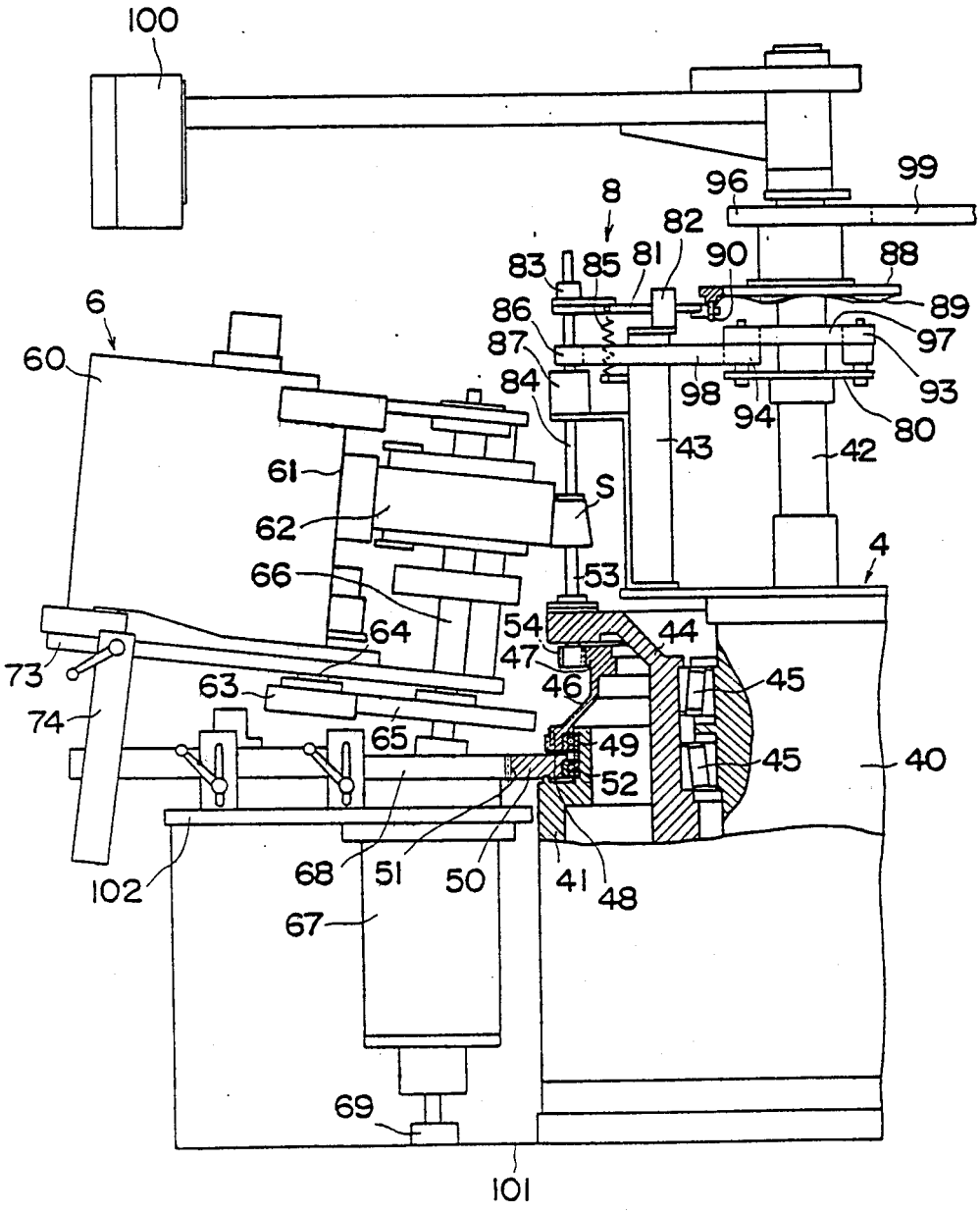
FIG. 7 is a partial sectional enlarged view showing in detail the construction in the vicinity of a printer.

Table Mechanism (with reference to FIG. 7)

The table mechanism 4 plays the most important role in the apparatus of the invention and is constructed to include at its center a stationary center portion 40 which is fixed on the bed 101 but rises to above the mounting platform 102. The index table 44 to be driven by the aforementioned index unit 12 is so mounted through bearings 45 and 45 that it can rotate on the axis of that stationary center portion 40. Moreover, the article rotating cylinder 46 and the printing rotary ring 50 are rotatably mounted through bearings 49 and 52, respectively, coaxially of the aforementioned index table 44 on a stationary frame 41 which is fixed on the bed 101 while taking such a shape as to enclose the mounting portion of that index table 44 on the stationary center portion 40. On the circumferential end portion of the aforementioned index table 44, there are rotatably and upright at such equal center angles the holding jigs 53 for holding the articles S without any slippage as are equal to the center angle for the intermittent rotations of that index table 44. To the lower end of each of the holding jigs 53 protruding downward from the index table 44, there is fixed a rotary gear 54 which is in meshing engagement with the first toothed portion of the aforementioned article rotating cylinder 46. On the upper surface of the aforementioned stationary center portion 40, there are fixed upright a center column 42 for providing the mounting base of the article clamping mechanism 8 and a mounting column 43 for holding a rocking arm 81 and the clamping shaft 84 both belonging to that clamping mechanism 8.

Incidentally, the article rotating cylinder 46 has its second toothed portion 48 meshing with the second drive gear 23 of the aforementioned rotation transmitting mechanism 2 so that it is rotationally driven by the latter.

Likewise that article rotating cylinder 46, the printing rotary ring 50, which is rotatably mounted on the stationary frame 41 through the bearing 52, has its toothed portion 51 formed in the outer circumference thereof and meshing with the toothed portion 68 of a drum gear 67 of the corresponding printer 6 so that the drum gear 67 of each printer 6 is rotated at an equal speed by the rotational drive of that first drive gear 20 of the aforementioned rotation transmitting mechanism 2, which is in meshing engagement with the toothed portion 51 of that printing rotary ring 50.

Figure 2:
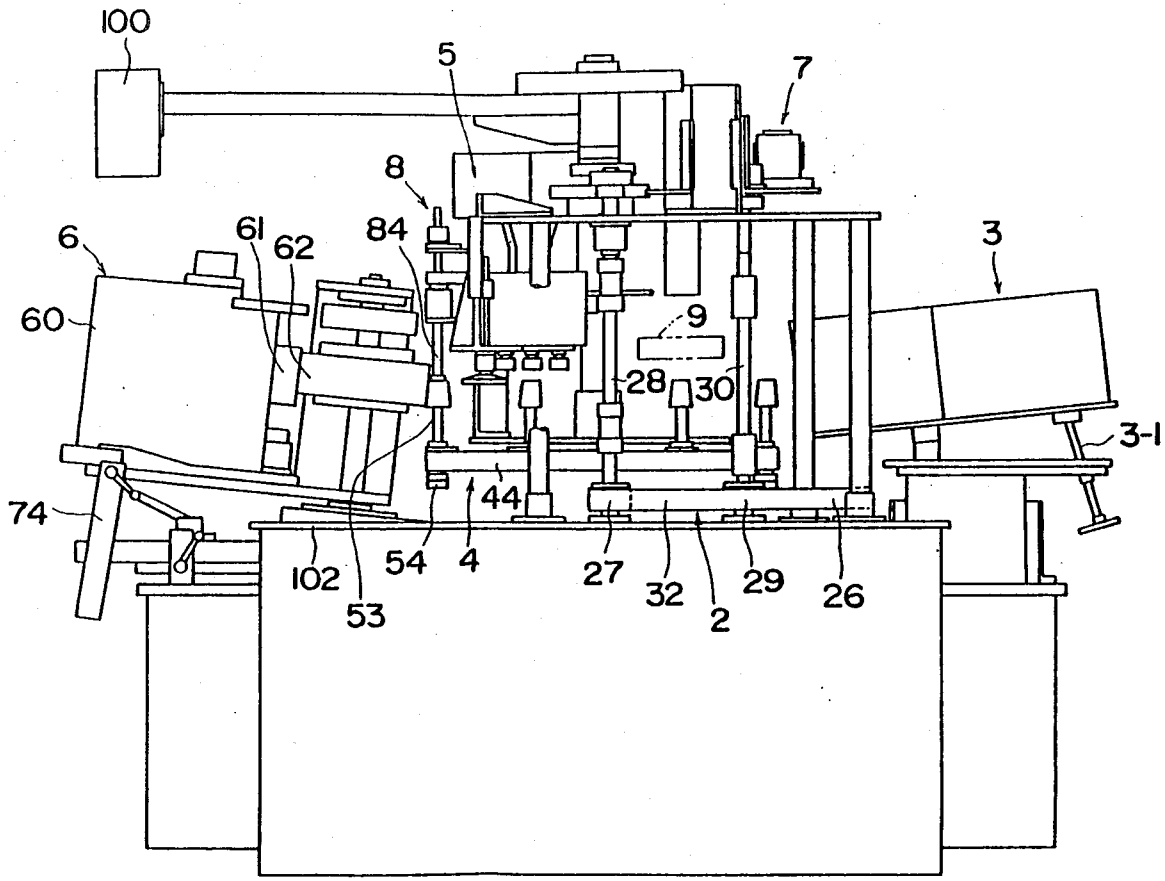
FIGS. 2 and 3 are a right-hand side elevation and a top plan view showing the same, respectively.

Printers 6 (especially with reference to FIGS. 2, 4 and 7)

The printers 6 prints the outer circumferences of the articles S, which are so held by the holding jigs 53 that they are being continuously rotated at a constant speed, with desired patterns in desired colors of ultraviolet-ray set type ink. On a printer base plate 73, there are mounted an inking roller unit 60, a printing drum 61 formed with the pattern to be printed, and the bracket 62 for transferring the desired color of ultraviolet-ray set type ink to the outer circumference of the article S. A drum gear 63 is fixed to that lower end of a drum shaft 64 fixing the printing drum 61 in a rotatable manner to that printer base plate 73, which protrudes downward from this base plate 73. A bracket gear 65 to mesh with the aforementioned drum gear 63 is fixed to that lower end of a bracket shaft 66 fixing the bracket 62 in a rotatable manner to the printer base plate 73, which protrudes downward from this base plate 73.

Moreover, the drum gear 67 is rotatably mounted upright through a bearing 69 on the base 101 just below the bracket 63. To the upper end of the shaft member mounted upright in the bottom wall of that drum gear 67, there is connected through an equal-speed joint 70 a rotary shaft 71, which has its upper end connected through another equal-speed joint 70 to the lower end of the bracket shaft 66.

Still morever, the aforementioned printed base plate 73 is attached through a position holding mechanism 74 to the mounting platform 102 so that the inclined position of the bracket 62 can be set in accordance with the inclined angle of the outer circumference of the article S to be printed.

Now, the drum gear 67 has its lower end rotatably mounted through the bearing 69 on the base 101 and its upper end portion rotatably held through a bearing 72 in the mounting platform 102 so that it is enabled to rotate while holding its upright position. Since the toothed portion 68 formed in the upper end of the drum gear 67 thus constructed is in meshing engagement with the toothed portion 51 of the printing rotary ring 50, the rotational drive force transmitted through the printing rotary gear 50 is transmitted partly to the bracket shaft 66 by way of the drum gear 67, the equal-speed joints 70 and the rotary shaft 71 and partly to the drum shaft 64 from the branket gear 65 through the drum gear 63.

Incidentally, the construction that the rotating force of the printing rotary ring 50 is to be transmitted to the bracket shaft 66 through the drum gear 67 having the equal-speed joints 70 and the rotary shaft 71 is intended to ensure the accurate transmission of the constant rotating speed, even if the bracket shaft 66 takes the inclined position as in the shown embodiment, because the bracket shaft 66 is inclined in accordance with the shape of the article S to be printed with respect to the printing rotary ring 50 rotating in a predetermined position at all times.

Figure 8:
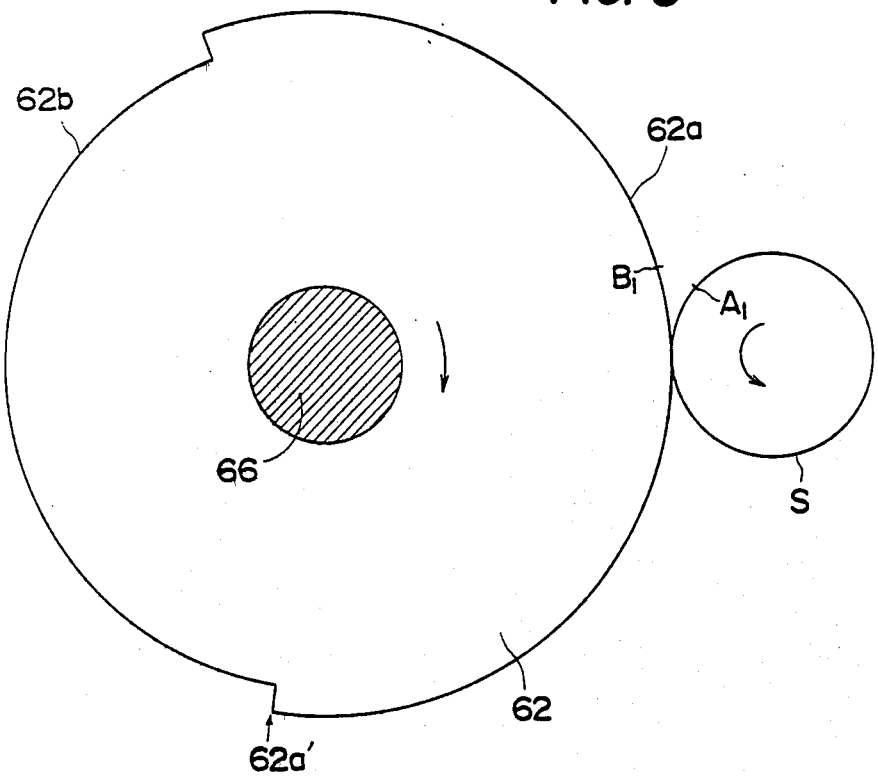
FIG. 8 is a top plan view showing the relationship between an article to be printed and the bracket of the printer.

As is quite natural, moreover, the bracket 62 has its outer circumference divided, as shown in FIG. 8, into a land surface portion **62*a*, which is used to transfer the ink from the printing drum 61 to the surface of the article S, and a recessed surface portion 62*b* which is so stepwise recessed inward from that land surface portion 62*a* that it may not abut against the outer circumference of the article S. The circumferential length of the printing land surface portion 62*a* is set to be twice as large as that of the outer circumferential portion of the article S having a circumferential speed equal to that of the branket 62** so that the smooth and reliable print of the article S may be achieved.

Each of the printers 6 is so arranged that its bracket 62 faces the predetermined stop position of the corresponding holding jig 53 which is supported on the intermittently rotatable index table 44.

Figure 9:
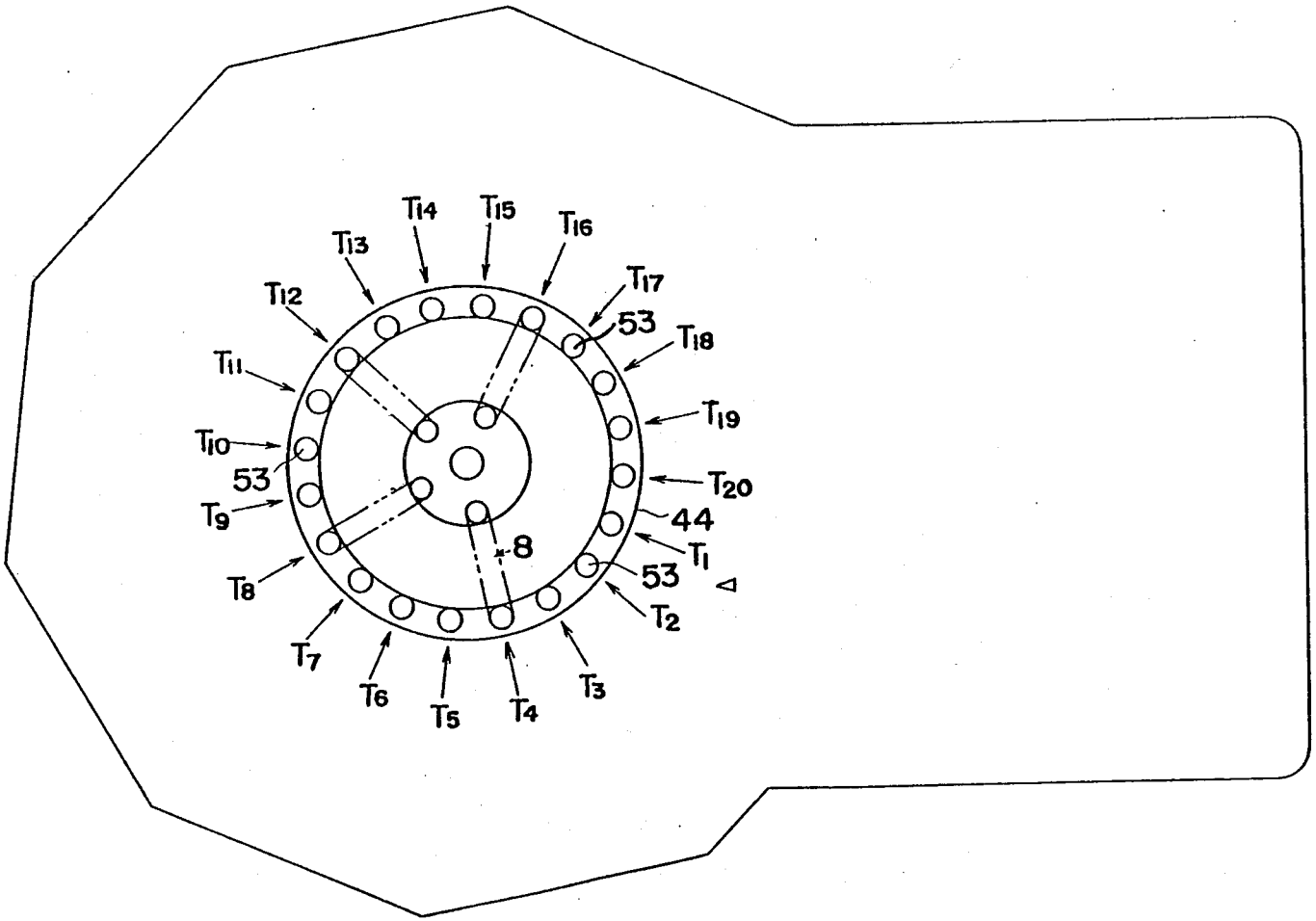
FIG. 9 is a top plan view showing the stop positions where the revolutions of the respective holding jigs are stopped.

In the case of the shown embodiment, as shown in FIG. 9, the index table 44 is intermittently rotated at the center angle of 18 degrees so that each of the holding jigs 53 is consecutively stopped at twenty stop positions $T_1$, $T_2$, - - - , and $T_{20}$. The respective printers 6 are so arranged that the printer 6 for applying yellow ink of ultraviolet-ray set type is positioned to face the stop position $T_4$, that the printer 6 for red ink is positioned to face the stop position $T_8$, that the printer 6 for blue ink is positioned to face the stop position $T_{12}$, and that the printer 6 for black ink is positioned to face the stop position $T_{16}$.

As a result, the article S loaded at the stop position $T_1$ onto the printing apparatus and held on the corresponding holding jig 53 has its outer circumference printed with the patterns of the yellow, red, blue and black ink in this order until it is unloaded at the stop position $T_{18}$ from that printing apparatus.

Figure 3:
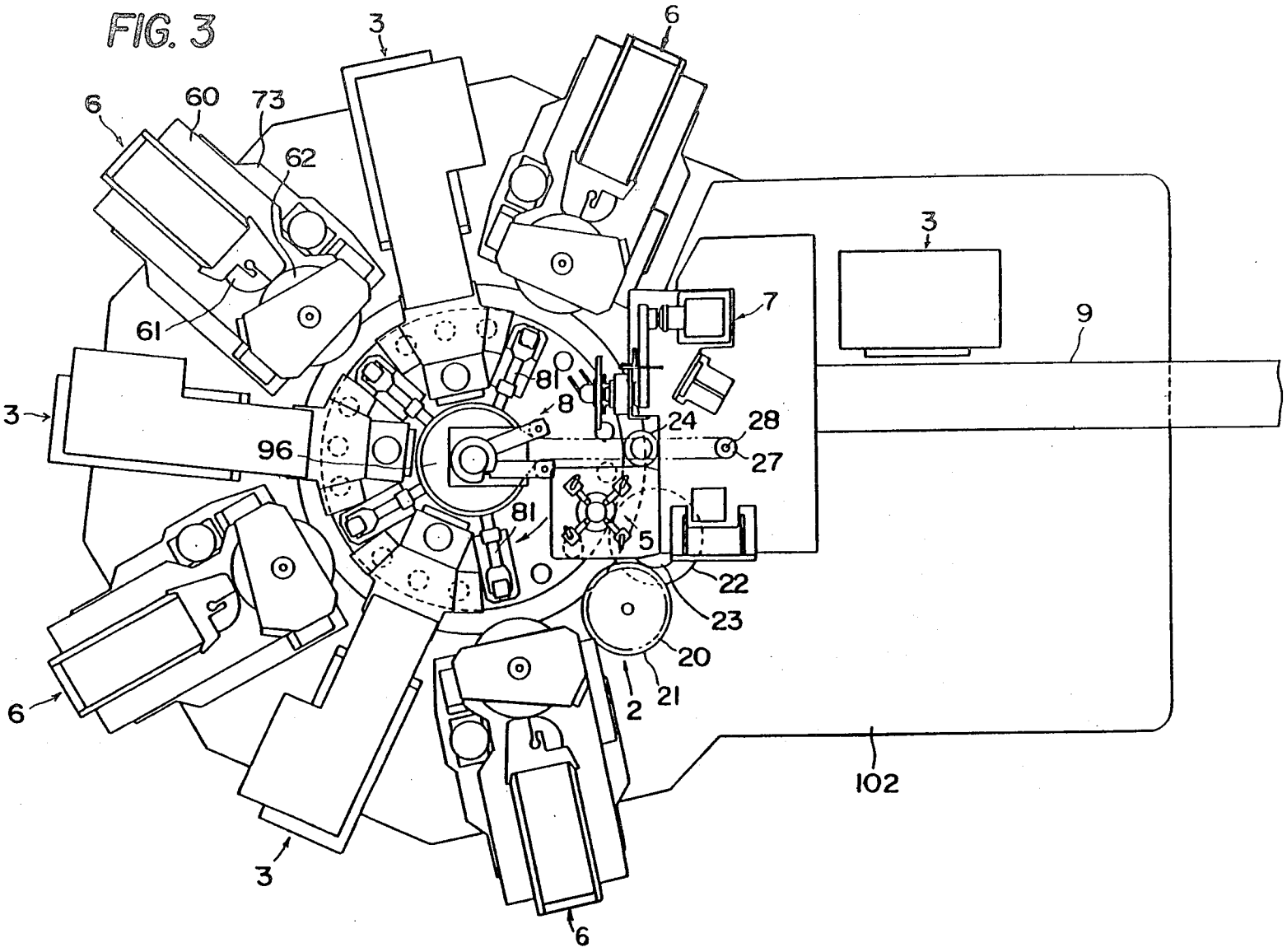

Article Clamping Mechanisms 8 (with reference to FIGS. 3, 4 and 7)

The article clamping mechanism 8 clamps the articles S, which are held on such holding jigs 53 as have their revolutions interrupted while rotating at their constant speed at the printing positions (i.e., at the stop positions $T_4$, $T_8$, $T_{12}$ and $T_{16}$ of FIG. 9) thereby to eliminate any idle rotation, i.e., any shear between the holding jigs 53 and the articles S held on the former during the printing operations of the articles.

Each of the article clamping mechanisms 8 thus far described is constructed to include a portion for clamping an article S onto the corresponding holding jig 53 and a portion for rotating that clamping portion at a speed equal to that of the article S.

The portion for exerting the clamping force upon the article S is constructed such that a follower roller 96 having a larger diameter is rotatably mounted on the upper end of the center column 42 of the table mechanism 4, such that there is integrally fixed to that follower roller 96 a cam disc 88 which is made rotatable about the aforementioned center column 42, and such that the cam disc 88 has its lower side formed on its circumferential edge portion with a plurality of cam portions 89 which correspond to the respective printing positions.

Above the stationary center portion 40 of the table mechanism 4, there are mounted on the upper ends of the mounting columns 43 through supporting brackets 82 in a manner to rock about the aforementioned center column 42 the rocking arms 81 in the number corresponding to the printing positions, which carry such cam followers 90 as can abut against the aforementioned cam portions 89. The clamping shaft 84 is attached to the leading end of each of the rocking arms 81 in a vertically immovable manner but in a rotatable manner although it is enabled to freely rotate by means of a bearing 83.

Between that rocking arm 81 and the mounting column 43, there is sandwiched under tension a spring 85 having a spring force, by which the cam follower 90 carried on the base end of the rocking arm 81 is biased to contact with the cam portions 89 at all times.

The clamping shaft 84 for directly exerting the clamping force upon the article S is rotatably and axially slidably borne in a guide bearing 87 which is secured to the mounting column 43. In the vicinity of that guide bearing 87, there is assembled with the guide bearing 87 a rotary roller 86 which is mounted idly irrotatably but axially slidably on that clamping shaft 84.

By making a third belt 99 run on both a second drive roller 95, which is fixed on the upper end of the loading shaft 28 of the rotation transmission mechanism 2, and the aforementioned follower roller 96, more specifically, the cam disc 88 is rotated integrally with the follower roller 96 so that the rocking arm 81 is rocked during the rotating operation of the index table 44 against the spring force of the spring 85 thereby to lift the clamping shaft 84 and so that this clamping shaft 84 is thursted during the stop period of the index table 44 by the elastic force of the spring 85 onto the article S which is stopped at one of the printing positions, i.e., the stop positions $T_4$, $T_8$, $T_{12}$ and $T_{16}$.

On the other hand, the portion for rotating at the speed equal to that of the article the clamping shaft for directly exerting the clamping force upon the article S is constructed such that transmission rollers 92 and first and second guide rollers 93 and 94, which are coaxially arranged in a manner to correspond to the respective clamping shafts 84, are rotatably mounted on a mounting table 80 which is fixed to the center column 42, and such that a first belt 97 is made to run on a first drive roller 91, which is fixed on the upper end of the holding rotary shaft 25 of the rotation transmission mechanism 2, and on the first guide rollers 93 while being guided by the transmission rollers 92, whereas a second belt 98 is made to run on each of the second guide rollers 94 and the corresponding rotary roller 86, thereby to rotate each of the clamping shafts 84 at the same speed as that of the articles S.

Setting Mechanisms 3 (with reference to FIGS. 2, 3 and 9)

The setting mechanisms 3 are units which are arranged along the transferred passages of the articles S downstream of and in a manner to correspond to the respective printers 6 so that they may abruptly set the printing ink applied to the articles S by those printers 6. Each of the ink setting mechanisms 3 thus arranged has an ultraviolet-ray lamp accommodated in the frame thereof and is mounted on the mounting platform 102 by means of a position holding mechanism 3-1 similarly to the printers 6.

In the case of the shown embodiment, the ink setting mechanisms 3 are arranged not only at the stop positions $T_6$, $T_{10}$ and $T_{14}$, respetively, but also at the sideway position of a carry-out belt conveyor 9.

Figure 1:
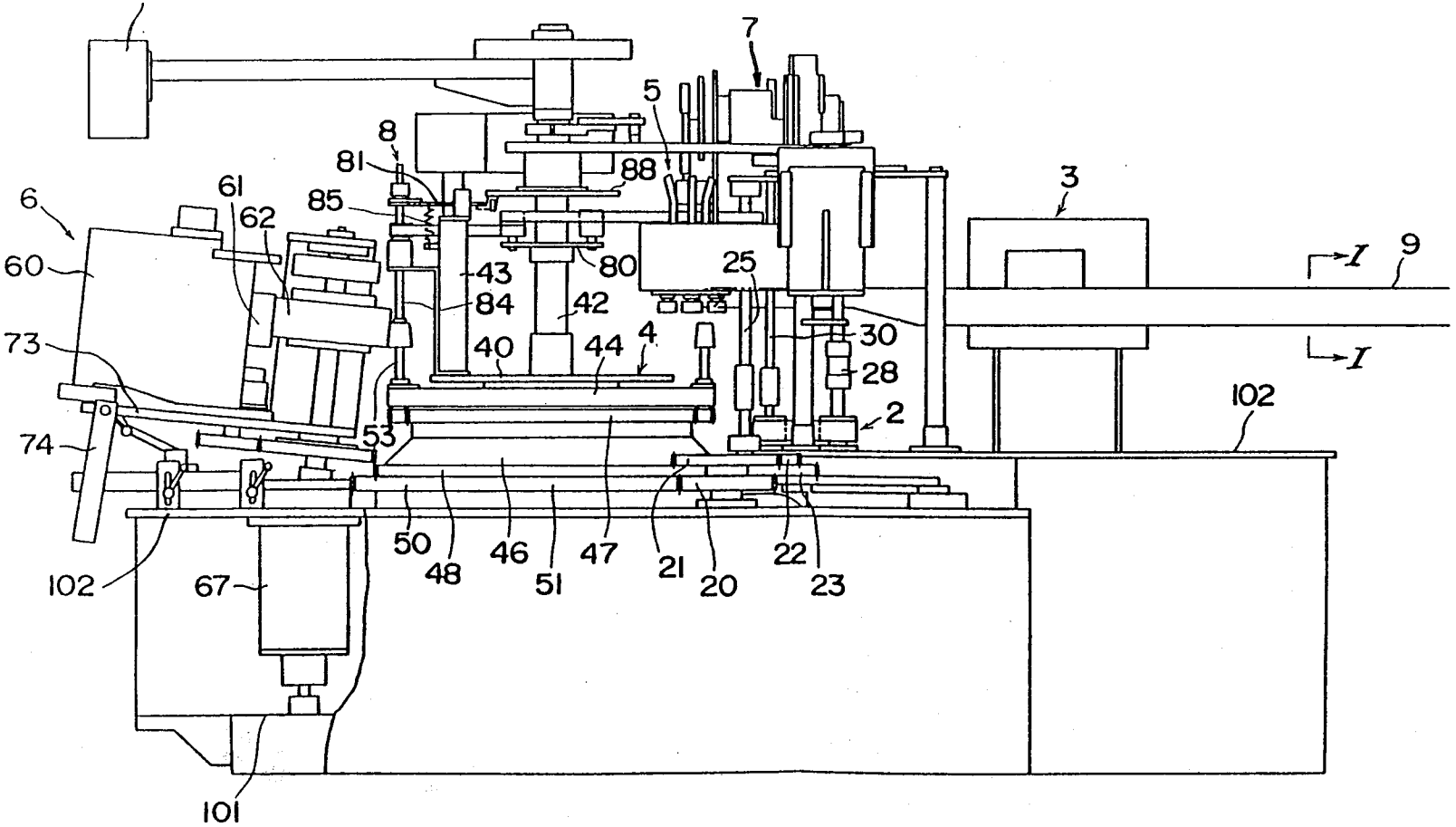
FIG. 1 is a front elevation showing the whole construction of one embodiment of the present invention.

Loading Mechanism 5 (with reference to FIGS. 1 to 3)

The loading mechanism 5 is driven by the loading shaft 28 of the rotation transmitting mechanism 2 thereby to receive and hold the articles S in predetermined positions through a not-shown feed chute and to drop and load the articles S one by one onto the holding jigs 53 which are stopped at the loading position (i.e., the stop position $T_1$) during the stop or blank period the index table 44.

Unloading Mechanism 7 (with reference to FIGS. 1 to 3)

The unloading mechanism 7 is driven by the unloading shaft 30 of the rotation transmitting mechanism 2 thereby to suck or unload the printed articles S one by one from the holding jigs 53, which are stopped at the stop position $T_{18}$ during the stop or blank period of the index table 44, by an evacuating operation and to place them as they are upon the carry-out belt conveyor 9.

Figure 10:
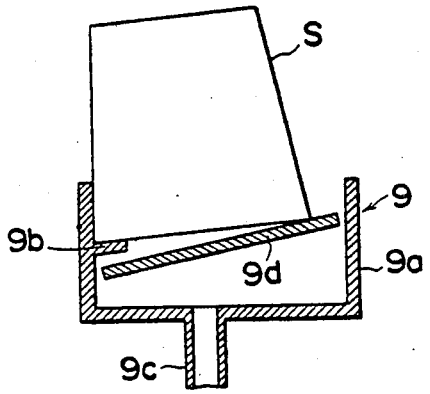
FIG. 10 is a longitudinal section showing a concrete example of the construction of a carry-out belt conveyor and taken along line I—I of FIG. 1.

Carry-out Belt Conveyor 9 (with reference to FIGS. 3 and 10)

The carry-out belt conveyor 9 conveys the printed and set articles S out of the printing apparatus, while rotating them, by the action of its conveyor belt **9*d*. This conveyor belt 9*d* is assembled in an inclined position in a conveyor frame 9*a* forming an elongated groove such that its lower side edge positioned below a wall step 9*b* which is formed to extend in a horizontal direction from one side wall of the frame 9*a*. This conveyor frame 9*a* is formed with a communication pipe 9*c* which provides communication between such an internal space of the frame 9*a* as is opened upward through the gap between that wall step 9*b* and the conveyor belt 9*d*** and the not-shown evacuating system.

More specifically, each of the articles S unloaded from the corresponding holding jig 53 and placed on the carry-out conveyor belt 9 by the action of the unloading mechanism 7 is conveyed, while having its one end seated on the wall step **9*b*, by the conveyor belt 9*d* so that it is carried out, while rotating in its inverted position, to a predetermined position by the running action of the conveyor belt 9*d***.

In this meanwhile, since the inside of the conveyor frame **9*a* is evacuated, it is considered that the articles S are conveyed, while being forced to rotate on the conveyor belt 9*d* and the wall step 9*b***, so that they may not fall down in their conveyed cources.

The conveyance of the articles S while rotating in their inverted positions is intended to effectively irradiating all the outer circumferences of the articles S with the ultraviolet ray by the action of the last ink setting mechanism 3 which is arranged in the vicinity of that carry-out belt conveyor 9, as shown in FIG. 3.

Figure 11:
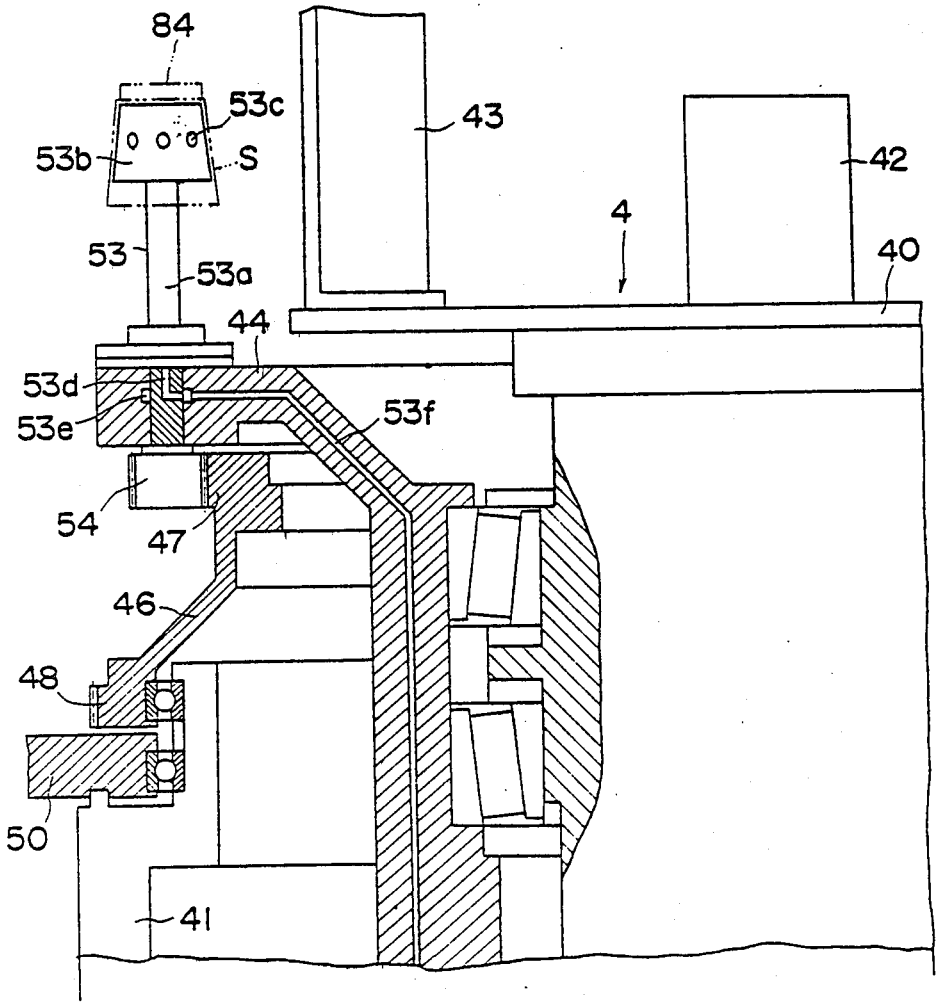
FIG. 11 is a partially longitudinal enlarged section showing the respective holding jigs and an evacuation passage formed in an index table.

On the other hand, as shown in FIG. 11, each of the holding jigs 53 is constructed such that a head 53*b*, on which each article S is closed fitted, is formed at the upper end of a shaft cylinder 53*a* acting as a rotary shaft. This shaft cylinder 53*a* of the holding jig 53 is formed therein with a communication passage 53*d* which has its upper end opend as suction ports 53*c* in the circumference and upper side of the head 53*b*.

On the other hand, the lower end of that communication passage 53*d* is opened in a circumferential groove 53*e*, which is formed in the index table 44 supporting the holding jig 53 closely and rotatably, and is connected with the not-shown evacuating system by way of an evacuation passage 53*f* which is formed in the index table 44 in a manner to communicate with that circumferential groove 53*e*.

As a result, the holding jig 53 exerts the evacuating action, although it is rotated at all times, upon the article S held on the head 53*b* by the suction, which transmits from the suction ports 53*c* by way of the evacuation passage 53*f*, the circumferential groove 53*e* and the communication passage 53*d*, so that it holds the article S thereon without any slippage by the action of that suction.

Here, the communication between the evacuation passage 53*f* and the not-shown evacuating system is limited to the stop positions $T_1$ to $T_{16}$ of the index table 44, i.e, to the positions from the loading one to the last printing one so that the suction is not effected from the stop position $T_{17}$ to the stop position $T_{20}$.

This limitation is intended to ensure the unloading operation of the articles S from the holding jigs 53 at the stop position $T_{18}$, i.e., at the unloading position.

On the other hand, a control panel unit 100 is rotatably attached to the upper end of the center column 42 of the table mechanism 4 thereby to allow the operator to control the operations of the printing apparatus, if necessary, from any position while monitoring the operations of the apparatus.

The operations of the printing apparatus having the constructions thus far described according to the present invention will be consecutively explained hereinafter.

First of all, the operations of the respective mechanisms constructing the apparatus of the present invention will be in the following.

The constant-speed rotating force from the main motor 10 is transmitted through the clutch brake 11 to the index unit 12 thereby to intermittently rotate the index table 44, which is mounted on that index unit 12, at the center angle of 18 degrees. The rotating force transmitted to that index unit 12 is fed as it is to the first and second gear boxes 13 and 14 thereby to continuously rotate both the first upright shaft 15 of the first gear box 13 and the second upright shaft 16 of the second gear box 14 at the constant speed.

The rotating force thus transmitted to the first upright shaft 15 is transmitted to the printing rotary ring 50, which is in meshing engagement with the first drive gear 20 fixed to the upper end of that first upright shaft 15, thereby to rotate those drum gears 67 of the respective printers 6, which are in meshing engagement with that printing rotary ring 50, until it rotationally drives the printing drums 61 and brackets 62 of the respective printers 6 at the predetermined speed in the same direction.

On the other hand, the transmission gear 21 is mounted on the upper end of the first upright shaft 15 separately of the first drive gear 20, and the second drive gear 23, which is coaxially fixed to the intermediate gear 22 meshing with that transmission gear 21, is in meshing engagement with the second toothed portion 48 of the article rotating cylinder 46. This article rotating cylinder 46 is rotationally driven at a speed determined by the number of the teeth of the intermediate gear 22 thereby to rotate the holding jigs 53, which have their rotary gears 54 meshing with that first toothed portion 47, at the desired rotational speed, i.e., at the desired r.p.m.

With the second toothed portion 48 of the article rotating cylinder 46 which is rotationally driven by the second drive gear 23, there meshes the follower gear 24 which is secured to the holding rotary shaft 25 mounted rotatably and upright on the mounting platform 102. As a result, the r.p.m. of the clamping shafts 84 of the article clamping mechanisms 8 rotationally driven by that holding rotary shaft 25 is determined by the number of the teeth of the intermediate gear 22 similarly to the holding jigs 53.

In short, the holding jigs 53 are driven at such an r.p.m. that the circumferential speed of the outer circumferences of the articles S held thereon becomes identical to that of the brackets 62, and the clamping shafts 84 are rotationally driven at the same speed as the aforementioned holding jigs 53.

The rotational drive of the holding jigs 53 will now be described in more detail. This rotational drive is transmitted through the first belt 97, which is made to run on both the first drive roller 91 fixed to the upper end of the holding rotary shaft 25 and the first guide roller 93 while being guided by the tranmission roller 92, to the second guide roller 94, which is integrated with the first guide roller 93, and further through the second belt 98, which is made to run on both that second guide roller 94 and the rotary rollers 86 mounted on the upper end portions of the clamping shafts 84 arranged corresponding to the stop positions $T_4$, $T_8$, $T_{12}$ and $T_{16}$, i.e, the respective printing positions, to those rotary rollers 86 thereby to rotationally drive the respective clamping shafts 84 mounting those rotary rollers 86 thereon.

Thus, the respective printers 6, the respective holding jigs 53 and the respective article clamping mechanisms 8 are rotationally driven by the single first upright shaft 15.

As a result, the same r.p.m. among the respective printers, holding jigs and article clamping mechanisms 6, 53 and 8 thus far described can be attained easily and reliably.

On the drive roller 26 which is fixed to the upper end of the second upright shaft 16, there is made to run the transmission belt 32, which is also made to run on the three rollers, i.e., the loading roller 27 fixed to the loading shaft 28 for driving the loading mechanism 5, the unloading roller 29 fixed to the unloading shaft 30 for driving the unloading mechanism 7, and the guide roller 31, thereby to drive the loading mechanism 5 and the unloading mechanism 7 and to rotationally drive the follower roller 96, which is fixed to the cam disc 88 mounted rotatably on the center column 42, from the second drive roller 95, which is fixed to the upper end of the loading shaft 28, through the third belt 99 so that the rocking arms 81 are rocked by the coactions of the cam portions 89 formed on the cam disc 88 and the cam followers 90 of the rocking arms 81 whereby the clamping shafts 84 are lifted during the rotating period of the index table 44 against the elastic force of the springs 85.

The respective mechanisms constructing the printing apparatus according to the present invention perform the operations thus far described. The printing operations of the articles S will be consecutively explained hereinafter.

The loading mechanism 5 having received the articles S from the not-shown loading chute drops and loads the articles S onto the holding jig 53, which is stopped at the stop position $T_1$, during the stop or blank period of the index table 44 which has its intermittent rotations interrupted.

Since, in this meanwhile, the communication passage 53*d* formed in the holding jig 53 stopped at that stop position $T_1$ is connected with the not-shown evacuating system, the articles S fed from the loading mechanism 5 are sucked and held immovably on the heat 53*b* of the holding jig 53.

The article S, which is loaded onto the holding jig 53 stopped at the stop position $T_1$, is indexed or intermittently moved to the stop positions $T_2$ and $T_3$ in accordance with the indexed intermittent rotations of the index table 44 until it reaches the stop position $T_4$.

At the instant when the article is stopped at the first printing position, i.e., at the stop position $T_4$, the corresponding bracket 62 rotating at the constant speed has its rotational position set such that its recessed surface portion 62*b* faces the article S under consideration. As a result, the article S having intermittently revolved is not subjected to the printing process simultaneously as it stops at that printing position.

This is intended to make more precise the printing registration for the multiple printing processes.

More specifically, the article S held on the holding jig 53 has its outer circumference rotating at the same circumferential speed as that of the circumference of the corresponding branket 62. In spite of this fact, it is only while the article S is at the stop positions T that the article S is rotating at the same circumferential speed as that of the bracket 62, and the article S is rotating at a completely different circumferential speed when it is revolving or being transferred. Therefore, if the printing process is started simultaneously as the holding jig 53 reaches one of those stop positions, there arises a fear that the printing registration may not be precisely achieved.

When the printing process of the first color at the stop position $T_4$ is completed, the article S is again indexed to intermittently revolve in the order of the stop positions $T_5$ and $T_6$ by the indexing actions of the index table 44 until it is irradiated at that stop position $T_6$ with the ultraviolet ray by the corresponding setting mechanism 3 to set the ultraviolet-ray set type ink which has been applied to the circumference thereof.

The article S having been subjected at the stop position $T_6$ to the setting treatment is indexed to the stop position $T_8$, i.e., the second printing position, in which it is additionally printed with the ink in the second color similarly to the aforementioned printing process at the first printing position.

Upon this second printing process, it is necessary that the second print to be overlapped on the first print be precisely registered with the first print. This registration of the second print with respect to the first print is achieved easily and precisely as a result that the holding jigs 53 and the brackets 62 are driven by the single first upright shaft 15.

More specifically, since both the holding jigs 53 and the brackets 62 are coupled by the meshing engagement between the first upright shaft 15 and the gears, the circumferential position of each holding jig 53 at the instant when the indexed revolution is interrupted at each stop position T is always made identical. Likewise, since the bracket 62 of each printer 6 is rotating at the constant speed, its circumferential position when the index table 44 is stopped at each time interval is always made identical.

Therefore, if the printing registration of the ink onto the land surface portion 62*a* of the bracket 62 is so set as to become identical to that of the printed article S while being informed in advance of both the circumferential position of the bracket 62 and the circumferential position of the article S held on the corresponding holding jig 53 at the time instant when the index table 44 is stopped, the printing position of the article S necessarily becomes precisely identical.

This printing registration of the article S will be explained more specifically in the following. The registered printing position of the article S is determined by the first printing process at the stop position $T_4$.

Therefore, the really precise printing registration is not required before the second or subsequent printing processes.

At the second or subsequent printing positions (i.e., the stop positions $T_8$, $T_{12}$ and $T_{16}$), the circumferential position of the article S having its revolutions interrupted does not fail to face that of the corresponding bracket 62 always in a predetermined positional relationship.

Therefore, by locating the position of the land surface portion 62*a* facing the registration position $A_1$ (which should be referred to FIG. 8) of the article S, which has been determined by the first printing process, at the registration position $B_1$ of the bracket 62 while being informed of which position of the land surface portion 62*a* of the bracket 62 that registration position $A_1$ faces during the stop period of the index table 44, both the two positions $A_1$ and $B_1$ at that printing position never fail to be precisely registered.

Thus, the setting of the printing registration $B_1$ of the land surface portion 62*a* of the bracket 62 of each printer 6 is performed on the basis of which position of that land surface portion 62*a* the printing registration $A_1$ of the article S faces. As a result, the ink to be applied from each printer 6 never fails to be remarkably precisely registered for the printing process.

Thus, the printing registration $B_1$ of the bracket 62 is set to correspond to the printing registration $A_1$ of the corresponding article S. However, it is not before the actual run of the printing apparatus which position of the land surface portion 62*a* the printing position $A_1$ of the article S faces.

It is, therefore, conceivable that the bracket 62 abuts against the circumference of the article at a position where its contact starting position 62*a*' (which should be referred to FIG. 8) slightly passes over the printing registration $A_1$ of the article S. In order that the printing process of the article S by the bracket 62 may be smoothly achieved even in that case, it is necessary to make the circumferential length of the land surface portion 62*a* of the bracket 62 twice as long as that of the article S.

During this printing process of the circumference of the article S at that printing position, the article S is held immovable on the holding jig 53 by the suction, and this holding jig 53 itself is so rotating that the circumferential speed of the article S held thereon is identical to that of the bracket 62. It is hardly conceivable that the article S idly shifts relative to its holding jig 53. However, in case the article S has its outer circumference formed into a frustoconical cylinder so that its circumferential speed is determined at the center of the printing area of its outer circumference, frictional forces acting in opposite directions are generated between the bracket 62 and the upper and lower areas of the outer circumference of the article S to abut against the bracket 62 are established to invite a fear that the article S may idly shift, although slightly, relative to its holding jig 53.

In order to ensure the prevention of that fear of the idle shear of the article S relative to the holding jig 53 during the printing process, the article clamping mechanism 8 is disposed to face each of the printers 6.

When the index table 44 is stopped, more specifically, the cam portions 89 fixed to the cam disc 88 rotating at the constant speed are released from their abutting contacts with the cam follower 90. As a result, the rocking arm 81 is rocked by the elastic force of the corresponding spring 85 thereby to carry down the clamping shaft 84 which is rotatably held on the leading end thereof.

Although that clamping shaft 84 is rotating at the same speed as that of the holding jigs 53, as has been described hereinbefore, the holding jig 53 holding that article S is stopped just below the clamping shaft 84 because it is during the stop period of the index table 44. As a result, the clamping shaft 84 has its lower end urged by the aforementioned elastic force of the spring 85 onto the article S being held on the holding jig 53 so that the article S is firmly clamped between the holding jig 53 and the clamping shaft 84.

By the actions of both the clamping force resulting from the corresponding holding jig and clamping shaft 53 and 84 and the suction of the holding jig 53, the article S is firmly held on the holding jig 53 during its printing period so that it is prevented from idly shifting with respect to the holding jig 53.

Thus, the article S, which is transferred, while intermittently revolving, by the indexed intermitting rotations of the index table 44, is multi-color printed, while being repeatedly printed and set in the consecutive manner, until it reaches the stop position $T_{18}$.

Immediately before the article S reaches the stop position $T_{18}$, its holding action through the suction by the holding jig 53 is released. Then, while the article S is halted at the stop position $T_{18}$, it is unloaded from the holding jig 53 and placed on the carry-out belt conveyor 9 by the action of the unloading mechanism 7 so that it is conveyed out of the printing apparatus by the action of that belt conveyor 9.

In the case of the shown embodiment, there is no space for arranging the setting mechanism 3 between the stop position $T_{16}$, i.e., the last printing position and the stop position $T_{18}$, i.e., the unloading position. As shown in FIGS. 1 and 3, therefore, the last setting mechanism 3 is disposed in the vicinity of the side of the carry-out belt conveyor 9.

Thus, by arranging the last setting mechanism 3 apart from the index table 44 but in the vicinity of the carry-out belt conveyor 9 or the like, a sufficient irradiation time of the ultraviolet ray can be retained so that the multiple prints applied to the article S to be carried out as a complete product can be sufficiently set.

In case the article S being conveyed by that carry-out belt conveyor 9 is to be exposed to the ultraviolet ray, it is sufficient that the belt conveyor 9 is so constructed, as shown in FIG. 10, that the article S being conveyed may be moved while rotating in its upright position.

More specifically, the article S being conveyed by he carry-out belt conveyor 9 has its one end seated on the conveyor belt **9*d* and its other end seated on the wall step 9*b* of the conveyor frame 9*a*, and the inside of this frame 9*a* is connected with the not-shown evacuating system by way of the communication pipe 9*c* formed in that frame 9*a*. As a result, the article S is partly held in its inverted position on the wall step 9*b* and the conveyor belt 9*d* by the suction, which is propagated through the gap between the wall step 9*b* and the conveyor belt 9*d*, and partly conveyed, while rotating, in the direction of the conveyor belt 9*d* by the running action of the belt 9*d***.

Thus, since the article S is conveyed, while rotating in its inverted position, by the action of the carry-out belt conveyor 9, it has its whole circumference irradiated reliably with the ultraviolet ray which is emitted from the setting mechanism 3 disposed in the vicinity of the side of that belt conveyor 9.

As has been described hereinbefore, according to the printing apparatus of the present invention, the outer circumferences of cylindrical articles having cylindrical circumferential walls can be multi-printed in precise registration with multiple colors. Since the ink applied is set before the subsequent printing process, the apparatus according to the present invention can completely exclude the disadvantage that the bracket of the printer for the subsequent printing process is blotted with that ink in a different color, which has already been applied to the article S.

Moreover, since ink in a different color can be additionally applied to the ink having already been applied, a completely composed color is enabled to appear thereby to freely exhibit a color of half tone and to remarkably reduce the number of the colors of ink to be used.

According to the printing apparatus of the present invention, therefore, all the colors except metal colors can be exhibited by the use of three colors of yellow, red and blue, and it is sufficient to determine the number of the printers so that the printing processes can be completed by the use of the four colors consisting of black for letters or frames in addition to the above-specified three colors.

Incidentally, when the mutli-printing processes are to be carried out by the use of the above-listed four colors, it is advantageous that the articles S are printed with these four colors in the order of the higher brightness, i.e., first the yellow ink, next the red ink, next the blue ink and finally the black ink.

This is because, if the color of the higher brightness is applied later, it is severely influenced by the color of the lower brightness having already been applied so that a more natural coloring cannot be expected. If the color of the lower brightness is applied later, on the contrary, it is not influenced, even if it is directly applied to the color having already been applied, by the underlying color of the higher brightness so that the respective colors can be multiply printed without resorting to any troublesome "offprint".

As is now apparent from the description thus far made, the present invention can enjoy the following many excellent advantages: that the multi-color printing processes can be accomplished smoothly without any mixing of the different colors of ink in the respective printers; that the printing registrations can be attained remarkably precisely and reliably with ease; that the numerous articles S can be printed continuously and uniformly; that the number of the colors to be used may be limited notwithstanding that not only a color of half tone but also most colors are enabled to appear by the printing processes so that the number of the printers can be four at most to simplify the whole construction of the printing apparatus and to provide this apparatus at a reasonable price; and that the printing registrations are invariable, once they are set, the subsequent printing processes can be automatically accomplished while ensuring the reliable registrations.

What is claimed is:

1. A multi-color printing apparatus for printing the outer surfaces of synthetic resin cylindrical articles, comprising:

an index table supporting at evenly spaced positions on the circumferential edge portion thereof, a plurality of holding jigs which are operative to hold said cylindrical articles securely in upright rotating positions, said index table being intermittently rotatable between predetermined stop positions;

a plurality of printers, rotating at a constant circumferential speed, facing the predetermined stop positions for printing said articles with desired colors of ultraviolet-ray set type ink;

a plurality of setting mechanisms oriented perpendicularly to the longitudinal axis of said cylindrical articles at positions downstream of said printers;

a loading mechanism for receiving said cylindrical articles and for loading the article onto said holding jigs;

an unloading mechanism for unloading the printed articles from said holding jigs; and an adjustable drive means for adjusting the circumferential rotational speed of said cylindrical articles to maintain the circumferential rotational speed of said articles equal to the constant circumferential rotational speed of said printers regardless of the diameter of said cylindrical articles.

2. A multi-color printing apparatus in accordance with claim 1, wherein said articles are held on said holding jigs by forces resulting from the evacuation of communication passages formed in said holding jigs.

3. A multi-color printing apparatus for printing the outer surfaces of synthetic resin cylindrical articles, comprising:

an index table supporting at evenly spaced positions on the circumferential edge portion thereof, a plurality of holding jigs which are operative to hold said cylindrical articles securely in upright rotating positions, said index table being intermittently rotatable between predetermined stop positions;

a plurality of printers, rotating at a constant circumferential speed, facing the predetermined stop positions for printing said articles with desired colors of ultraviolet-ray set type ink;

a plurality of setting mechanisms oriented perpendicularly to the longitudinal axis of said cylindrical articles at positions downstream of said printers;

a loading mechanism for receiving said cylindrical articles and for loading the article onto said holding jigs;

an unloading mechanism for unloading the printed articles from said holding jigs; and an adjustable drive means, for rotating said cylindrical articles, comprising a motor, the motion of which is transmitted through a shaft to a transmission gear then through an intermediate gear to a gear which drives said holding jigs, said intermediate gear being interchangeable to permit selection of the size of the intermediate gear to obtain the desired rotational speed of said articles.

4. A multi-color printing apparatus in accordance with claim 3, wherein said articles are held on said holding jigs by forces resulting from the evacuation of communication passages formed in said holding jigs.

5. A multi-color printing apparatus for printing the outer surfaces of synthetic resin cylindrical articles, comprising:

an index table supporting at evenly spaced positions on the circumferential edge portion thereof, a plurality of holding jigs which are operative to hold said cylindrical articles securely in upright rotating positions, said index table being intermittently rotatable between predetermined stop positions;

a plurality of printers, rotating at a constant circumferential speed, facing the predetermined stop positions for printing said articles with desired colors of ultraviolet-ray set type ink;

a plurality of setting mechanisms oriented perpendicularly to the longitudinal axis of said cylindrical articles at positions downstream of said printers;

a loading mechanism for receiving said cylindrical articles and for loading the article onto said holding jigs;

an unloading mechanism for unloading the printed articles from said holding jigs; and an adjustable drive means, for adjusting the circumferential rotational speed of said cylindrical articles to maintain the circumferential rotational speed of said articles equal to the constant circumferential rotational speed of said printers regardless of the diameter of said cylindrical articles, comprising a motor, the motion of which is transmitted through a shaft to a transmission gear then through an intermediate gear to a gear which drives said holding jigs, said intermediate gear being interchangeable to permit selection of the size of the intermediate gear to obtain the desired rotational speed of said articles.

6. A multi-color printing apparatus in accordance with claim 5, wherein said articles are held on said holding jigs by forces resulting from the evacuation of communication passages formed in said holding jigs.

7. A multi-color printing apparatus for printing the outer surfaces of synthetic resin cylindrical articles, comprising:

an index table supporting at evenly spaced positions on the circumferential edge portion thereof a plurality of holding jigs which are operative to hold said cylindrical articles securely in upright rotating positions, said index table being intermittently rotatable between predetermined stop positions;

a plurality of printers, rotating at a constant circumferential speed, arranged to face the predetermined stop positions for printing said articles with desired colors of ultraviolet-ray set type ink;

a plurality of setting mechanisms oriented perpendicularly to the longitudinal axis of said cylindrical articles at positions downstream of said printers;

a loading mechanism for receiving said articles and for loading the articles onto said holding jigs;

an unloading mechanism for unloading the printed articles from said holding jigs;

a plurality of article clamping mechanisms arranged to face said printers for clamping said articles onto said holding jigs when said index table is stationary, said clamping mechanisms having clamping shafts, for exerting the clamping forces upon said articles, which are continuously rotated at the same speed as the holding jigs; and an adjustable drive means for adjusting the circumferential rotational speed of said cylindrical articles to maintain the circumferential rotational speeds of said articles equal to the constant circumferential rotational speed of said printers regardless of the diameter of said cylindrical articles.

8. A multi-color printing apparatus in accordance with claim 7, wherein said articles are held on said holding jigs by forces resulting from the evacuation of communication passages formed in said holding jigs.

9. A multi-color printing apparatus for printing the outer surfaces of synthetic resin cylindrical articles, comprising:

an index table supporting at evenly spaced positions on the circumferential edge portion therof, a plurality of holding jigs which are operative to hold said cylindrical articles securely in upright rotating positions, said index table being intermittently rotatable between predetermined stop positions;

a plurality of printers rotating at a constant circumferential speed and facing the predetermined stop positions for printing said articles with desired colors of ultraviolet-ray set type ink, said printers being constructed and arranged such that their mounting attitude with respect to the outer surface of a cylindrical article at a stop position may be freely changed and set;

a plurality of setting mechanisms oriented perpendicularly to the longitudinal axis of said cylindrical articles at positions downstream of said printers;

a loading mechanism for receiving said cylindrical articles and for loading the articles onto said holding jigs;

an unloading mechanism for unloading the printed articles from said holding jigs; and an adjustable drive means for adjusting the circumferential rotational speed of said cylindrical articles to maintain the circumferential rotational speed of said articles equal to the constant circumferential rotational speed of said printers regardless of the diameter of said cylindrical articles.

10. A multi-color printing apparatus for printing the outer surfaces of synthetic resin cylindrical articles, comprising:

an index table supporting at evenly spaced positions on the circumferential edge portion thereof, a plurality of holding jigs which are operative to hold said cylindrical articles securely in upright rotating positions, said index table being intermittently rotatable between predetermined stop positions;

a plurality of printers rotating at a constant circumferential speed and facing the predetermined stop positions for printing said articles with desired colors of ultraviolet-ray set type ink, said printers being constructed and arranged such that their mounting attitude with respect to the outer surface of a cylindrical article at a stop position may be freely changed and set;

a plurality of setting mechanisms oriented perpendicularly to the longitudinal axis of said cylindrical articles at positions downstream of said printers;

a loading mechanism for receiving said cylindrical articles and for loading the articles onto said holding jigs;

an unloading mechanism for unloading the printed articles from said holding jigs;

a plurality of article clamping mechanisms arranged to face said printers for clamping said articles onto said holding jigs when said index table is stationary, said clamping mechanisms having clamping shafts, for exerting the clamping forces upon said articles, which are continuously rotated at the same speed as the holding jigs; and an adjustable drive means for adjusting the circumferential rotational speed of said cylindrical articles to maintain the circumferential rotational speeds of said articles equal to the constant circumferential rotational speed of said printers regardless of the diameter of said cylindrical articles.

11. A multi-color printing apparatus for printing the outer surfaces of synthetic resin cylindrical articles, comprising:

an index table supporting at evenly spaced positions on the circumferential edge portion therof, a plurality of holding jigs which are operative to hold said cylindrical articles securely in upright rotating positions, said index table being intermittently rotatable between predetermined stop positions;

a plurality of printers rotating at a constant circumferential speed and facing the predetermined stop positions for printing said articles with desired colors of ultraviolet-ray set type ink, said printers being constructed and arranged such that their mounting attitude with respect to the outer surface of a cylindrical article at a stop position may be freely changed and set;

a plurality of setting mechanisms oriented perpendicularly to the longitudinal axis of said cylindrical articles at positions downstream of said printers;

a loading mechanism for receiving said cylindrical articles and for loading the articles onto said holding jigs;

an unloading mechanism for unloading the printed articles from said holding jigs; and an adjustable drive means for rotating said cylindrical articles comprising, a motor, the motion of which is transmitted through a shaft to a transmission gear then through an intermediate gear to a gear which drives said holding jigs, said intermediate gear being interchangeable to permit selection of the size of the intermediate gear to obtain the desired rotational speed of said articles.

12. A multi-color printing apparatus for printing the outer surfaces of synthetic resin cylindrical articles, comprising:

an index table supporting at evenly spaced positions on the circumferential edge portion thereof, a plurality of holding jigs which are operative to hold said cylindrical articles securely in upright rotating positions, said index table being intermittently rotatable between predetermined stop positions;

a plurality of printers rotating at a constant circumferential speed and facing the predetermined stop positions for printing said articles with desired colors of ultraviolet-ray set type ink, said printers being constructed and arranged such that their mounting attitude with respect to the outer surface of a cylindrical article at a stop position may be freely changed and set;

a plurality of setting mechanisms oriented perpendicularly to the longitudinal axis of said cylindrical articles at positions downstream of said printers;

a loading mechanism for receiving said cylindrical articles and for loading the articles onto said holding jigs;

an unloading mechanism for unloading the printed articles from said holding jigs; and an adjustable drive means for adjusting the circumferential rotational speed of said cylindrical articles to maintain the circumferential rotational speed of said articles equal to the constant circumferential rotational speed of said printers regardless of the diameter of said cylindrical articles comprising, a motor, the motion of which is transmitted through a shaft to a transmission gear then through an intermediate gear to a gear which drives said holding jigs, said intermediate gear being interchangeable to permit selection of the size of the intermediate gear to obtain the desired rotational speed of said articles.

* * * * *